US005518849A

United States Patent [19]

Sato et al.

[11] Patent Number: 5,518,849

[45] Date of Patent: May 21, 1996

[54] FERRITE CARRIER FOR ELECTROPHOTOGRAPHIC DEVELOPER AND DEVELOPER USING SAID CARRIER

[75] Inventors: Yuji Sato; Masahiro Ogata; Kouichi Shimizu; Norio Takei; Toshio Honjo, all of Kashiwa, Japan

[73] Assignee: Powdertech Co., Ltd., Kashiwa, Japan

[21] Appl. No.: 353,061

[22] Filed: Dec. 9, 1994

[30] Foreign Application Priority Data

Dec. 15, 1993 [JP] Japan ..... 5-342183
Oct. 27, 1994 [JP] Japan ..... 6-286103

[51] Int. Cl.[6] ..... G03G 9/107

[52] U.S. Cl. ..... 430/108

[58] Field of Search ..... 430/106, 108, 430/109

[56] References Cited

U.S. PATENT DOCUMENTS 5,422,216 6/1995 Smith et al. ..... 430/108

FOREIGN PATENT DOCUMENTS 580135 1/1994 European Pat. Off. ..... 430/108

OTHER PUBLICATIONS

Patent Abstracts of Japan–vol. 8, No. 257 (P–316) Nov. 24, 1984 & JP–A–59 127 054 (Hitachi) Jul. 21, 1984 *Abstract*.

Database WPI–Week 8432 Derwent Publications Ltd., London, GB; AN 84–197300 & JP–A–59 111 158 (Hitachi) Jun. 27, 1984 *abstract*.

Database WPI–Week 8432, Derwent Publications Ltd., London, GB; AN 84–197304 & JP–A–59 111 162 (Hitachi) Jun. 27, 1984 *abstract*.

*Primary Examiner*—John Goodrow
*Attorney, Agent, or Firm*—Bucknam and Archer

[57] ABSTRACT

This invention provides a ferrite carrier for an electrophotographic developer characterized in that a core material is ferrite particle composed of 17.0 to 29.0 mol % of $Li_2O$ and 71.0 to 83.0 mol % of $Fe_2O_3$, exhibits a resistance of $2.5\times10^8$ to $2.5\times10^9$ Ω when a voltage of 250 V is applied, satisfies the relationship: $a_1-a_2 \leqq 1.5$ when the resistance ($R_1$) of the ferrite particle exhibited when a voltage of 250 V is applied thereto is taken as $a_1\times10^b$ Ω and the resistance ($R_2$) thereof exhibited when a voltage of 1000 V is applied thereto is taken as $a_2\times10^b$ Ω (with the proviso that $1.0\leqq a_1<10$, $0.1\leqq a_2$, and b is an integer of 6 to 9), and the carrier prepared by coating the ferrite particle with a resin exhibits a resistance of $1.0\times10^9$ to $1.0\times10^{15}$ Ω when a voltage 250 V is applied thereto, and has a true specific gravity of 4.70 or below.

5 Claims, 4 Drawing Sheets

FERRITE CARRIER FOR ELECTROPHOTOGRAPHIC DEVELOPER AND DEVELOPER USING SAID CARRIER

BACKGROUND OF THE INVENTION

1. Field of the Invention

The present invention relates to a carrier for a two-component type electrophotographic developer for use in a copying machine, printer or the like, and a developer using said carrier.

2. Prior Art

A two-component type developer used for electrophotography is composed of a toner and a carrier. The carrier is stirred and mixed with the toner in a development box to give a desired charge to the toner, and then carries the thus-charged toner onto electrostatic latent images on a photoreceptor to develop the latent images, thereby forming toner images.

The carrier thus used remains on a magnet, and is then returned again to the development box, stirred again and mixed with a fresh toner for repeated use.

Accordingly, it is a matter of course in order to make it possible to stably keep desired image characteristics (such as an image density, fog, white spots (or carrier scattering), gradation, resolution) from the initiation of service life test until the end that the carrier constituting the developer is required to exhibit stable constant characteristics during the period of service life.

Conventional carriers for an electrophotographic developer include reduced iron powder, atomized iron powder, iron powder prepared by pulverizing cutting wastage and subjecting the obtained particles to size classification, and surface-oxidized iron powder having a thin iron oxide layer on the surface. However, these conductive carriers have too low resistance and even firmly surface-oxidized iron powder exhibits a dielectric breakdown voltage of as low as 300 V or below, though it is most excellent in breakdown strength among them. Therefore, when a low bias voltage is applied in the development using such a carrier, leakage occurs, so that the solid black image area thus developed has a high density but is not uniform, and the resulting copy has image deficiencies such as many brush marks and distortion of fine-linear images.

Further, various resin-coated iron carriers obtained by coating the surface of iron powder with various resin have also been known (see Japanese Patent Application Laid-Open Gazettes Nos. Sho 56-50337 and Sho 56-84402).

When the core shape off the resin-coated iron carrier is not uniform, the resin peels off from the carrier core material during the service life test to result in leakage phenomenon at the development because of the low resistance of the core material.

On the other hand, in a spherical iron powder particle (spherical steel particle), which is easy to coat a resin uniformly, as the core, the electric field for development in a solid black area is weakened by the injection of charge from a magnet roll in the initial image of development owing to the insulating properties of the carrier, so that the solid black image developed has a lowered density particularly in the central area of the image, i.e., suffers from so-called edge effect.

The spherical steel particle has a large true specific gravity (about 7.8) and an apparent density of 4.5 to 5.0 g/cm$^3$, so that toner particles fusion-adhere to the surface of the carrier particles during the service-life test owing to the friction and/or collision of carrier particles with each other to cause the "spent"-phenomenon and that the resin layer peels off significantly to expose the conductive core, which causes leakage to and the initial image qualities are not maintained. Thus, no satisfactory durability has been attained as yet with respect to the resin-coated carrier having a spherical steel particle as the core.

There has recently been proposed the use of a soft ferrite represented by the formula: $MO_a\,M'O_b(Fe_2O_3)_x$ (wherein M and M' each represents a metal element; and a, b and x are each an integer), for example, Ni—Zn ferrite, Mn—Zn ferrite or Cu—Zn ferrite in the carrier used in a two-component type developer system instead of the above surface-oxidized iron powder or resin-coated iron powder according to the prior art for the purpose of overcoming the above disadvantages to attain high-quality images (see Japanese Patent Application Publication Gazettes Nos. Sho 56-52305 and Sho 62-40705). Such carriers are actually commercially available.

Main reasons why the ferrite carrier is suitable for forming a high-quality image are as follows:

(1) the ferrite carrier has a dielectric breakdown voltage of as high as 1000 V or above, so that no potential of electrostatic latent images formed on a photoreceptor leaks to the carrier in development to give no brush marks, etc., (2) a ferrite carrier is composed of oxides, so that it does not deteriorate in service and exhibits a long service life, (3) the above ferrite has a true specific gravity of as low as about 5.0 and an apparent density of as low as 2.5 to 3.0 g/cm$^3$, though the spherical iron (steel) particle has a true specific gravity of as high as about 7.8 and an apparent density of as high as 4.5 to 5.0 g/cm$^3$. Therefore, the ferrite carrier causes the "spent"-phenomenon to a small extent due to the friction and/or collision of carrier particles with each other and the resin layer peels off to a small extent as compared with the carrier having a spherical iron core. Actually, a currently commercially available developer exhibits a service life lengthened by at least several times, and (4) since a soft ferrite has a saturation magnetization of 15 to 80 emu/g which is smaller than that of an ordinary iron particle (180 to 200 emu/g), ears formed on a magnetic brush for development is so soft that the toner images formed on a photoreceptor is abraded to a small extent by the ears of brush to develop images excellent in resolution.

As described above, the soft ferrite carrier has many advantageous characteristics for providing high-quality images as compared with a iron powder carrier.

However, commercially available Ni—Zn and Cu—Zn ferrite carriers are not advantageous in that the resistance of the core material is high. For example, Ni—Zn ferrite particle exhibits a resistance of about $8.0\times10^9$ to $2.0\times10^{11}$ Ω, when a voltage of 250 V is applied thereto, while Cu—Zn ferrite particle exhibits a resistance of about $5.0\times10^9$ to $5.0\times10^{10}$ Ω, when a voltage of 250 V is applied thereto.

Accordingly, a desired image density is obtained in a narrow region in the development using such a carrier. Specifically, a carrier prepared by coating a soft ferrite particle with a resin completely uniformly does not develop satisfactory solid black images owing to its high insulating properties, while a soft ferrite carrier coated with a thin resin layer has the problem that the resin layer peels off owing to the friction and/or collision of carrier particles with each other particularly in the service life test and does not maintain the initial image qualities, though the carrier is superior to the iron carrier of the prior art in durability. Further, since the core has a high resistance, solid black images of too high a density are difficult to be developed in the initial stage of the development. Therefore, most of the developers are prepared so as to have a lower amount of charge for the purpose of attaining a desired image density, which causes trouble due to environmental variation such as fogging at high humidity and toner scattering in the service life test.

Recently, a proposal has been made that a resin composition incorporated a conductive material in it is applied to the core material in enhanced thickness so that a carrier is prepared which is improved in durability and exhibits a lowered resistance to give a desired image density in development (see Japanese Patent Application Laid-Open Gazette No. Sho 62-182759). However, this proposal has a problem that the conductive material cannot homogeneously be dispersed in the resin, so that the resulting carrier undergoes resistance variation in the service life test to result in a poor durability.

Recently, digital copying machines and laser beam printers have been spread, and these machines and printers are of reversal development system involving the application of a high bias voltage. Therefore, the carrier to be used in them is required to have a higher dielectric breakdown voltage. Further, the development is required to give high-quality images having a high image density and good gradation. Furthermore, the developer is also required to be maintenance-free for use, i.e., to have such a durability as to permit the use over the machine service life.

To lengthen the service life of a carrier, it is necessary to reduce the weight of a carrier. However, no satisfactory carrier has been found as yet.

Further, severe environmental regulation has recently been made in North America and Europe. With respect to the regulation of waste, for example, heavy metals such as Ni, Cu and Zn are the objects of regulation in, for example, Title 22 of the State Law of California, U.S.A. Some of the ferrite carriers of the prior art are also included in the of regulation, when the metal content is high. In the future, the regulation will become even more severe, so that the development of a carrier free from the heavy metals included among the objects of regulation has been expected.

Meanwhile, a stoichiometric ferrite having a $Li_2O$ content of 16.7 mol % has been proposed as a Li-based ferrite (see Japanese Patent Application Laid-Open Gazette No. Sho 50-56946). A ferrite containing such a stoichiometric ferrite and having a $Li_2O$ content lower than 16.7 mol % has such a high true specific gravity and such a high apparent density which are not suitable for a high-durability carrier. Further, this ferrite is nearly equivalent to Ni—Zn and Cu—Zn ferrites in resistance, and does not attain a sufficiently high image density in development at a low electric potential.

Further, the mixing ratio of $Li_2O$ or $Li_2CO_3$ to $Fe_2O_3$ is low and these starting materials are very different in true specific gravity, so that a homogeneous dispersion of them in each other is difficult. Therefore, when a developer containing the thus produced Li-based ferrite carrier is used, it is liable to cause the carrier to fluctuate in magnetization per particle, and further to cause the carrier to scatter so that many white spots in development are produced.

SUMMARY OF THE INVENTION

An object of tile present invention is to solve the above problems of the carriers of the prior art thereby to provide a carrier for an electrophotographic developer which can give high-quality images and is excellent in durability, particularly one which is suitably used in a digital copying machine or laser beam printer to develop uniform solid black images of a high density without causing white streaks, etc., and which can give high-quality copies excellent in gradation and resolution for a prolonged period.

Another object of the present invention is to provide a carrier for an electrophotographic developer which permits wide design freedom for attaining desired image characteristics and which can comply with the severe environmental regulation.

Under these circumstances, the inventors of the present invention have made studies for the purpose of finding out a carrier which has a high dielectric breakdown voltage, exhibits little voltage dependence, has a lower resistance than that of the ferrite particle of the prior art, and is reduced in weight to exhibit improved durability. As a result of the studies, they have found that a Li-based ferrite is the most suitable. Further, they have made intensive studies to find out that the above objects can be attained when the ferrite takes a specific mixing ratio. To explain more precisely, they have directed their attention to the molar ratio of $Li_2O$ to $Fe_2O_3$ to find out that a ferrite carrier which has a lowered resistance and a reduced weight as compared with those of the ferrite carrier of the prior art can be prepared by mixing $Li_2O$ with $Fe_2O_3$ within a certain range to obtain a mixture having a $Li_2O$ content higher than that of the stoichiometric ferrite, granulating the mixture and firing the thus obtained granulate. The present invention has been accomplished on the basis of these findings.

Namely, the present invention relates to a ferrite carrier for an electrophotographic developer characterized in that a core material is a ferrite particle composed of 17.0 to 29.0 mol % of $Li_2O$ and 71.0 to 83.0 mol % of $Fe_2O_3$, exhibits a resistance of $2.5\times10^8$ to $2.5\times10^9$ Ω when a voltage of 250 V is applied, satisfies the relationship: $a_1-a_2\leqq1.5$ when resistance ($R_1$) of the ferrite particle exhibited when a voltage of 250 V is applied thereto is taken as $a_1\times10^b$ Ω and the resistance ($R_2$) thereof exhibited when a voltage of 1000 V is applied thereto is taken as $a_2\times10^b$ Ω (with the proviso that $1.0\leqq a_1<10$, $0.1\leqq a_2$, and b is an integer of 6 to 9), and the carrier prepared by coating the ferrite particle with a resin exhibits a resistance of $1.0\times10^9$ to $1.0\times10^{15}$ Ω when a voltage of 250 V is applied thereto, and has a true specific gravity of 4.70 or below.

The present invention will now be described in more detail.

The ferrite carrier of the present invention is a Li-based ferrite carrier composed of 17.0 to 29.0 mol % of $Li_2O$ and 71.0 to 83.0 mol % of $Fe_2O_3$, preferably 19.0 to 28.0 mol % of $Li_2O$ and 72.0 to 81.0 mol % of $Fe_2O_3$.

When the $Li_2O$ content is less than 17.0 mol %, the resulting carrier will exhibits too high a resistance, so that reproduction of high-density solid black area with the carrier at the time of development will be difficult. Further, the resulting resin-coated carrier will give images suffering from fog and significant edge effect on the images and will have a true specific gravity exceeding 4.70, thus failing to attain weight reduction and durability. Furthermore, the carrier will exhibit fluctuation in magnetization to cause significant carrier scattering (white spots) unfavorably.

On the contrary, when the $Li_2O$ content exceeds 29.0 mol %, the resulting core particle of the ferrite carrier will exhibit a saturation magnetization of less than 43 emu/g and the true specific gravity, apparent density and resistance of the ferrite carrier will be too low. Therefore, when a carrier prepared by coating the ferrite particle with a resin is subjected to the service life test with a machine for practical use, the resin layer will peel off to cause leakage owing to the low resistance of the core. Further, the carrier is composed of light-weight and lowly magnetizable particles, which are difficult to keep on a magnet in a development box at the time of development and are extremely liable to scatter onto a photoreceptor drum to give flaws thereto. This is the reason why image deficiencies such as white streaks and black spots occur suddenly and the service life of the carrier is shortened unfavorably.

Figure 1:
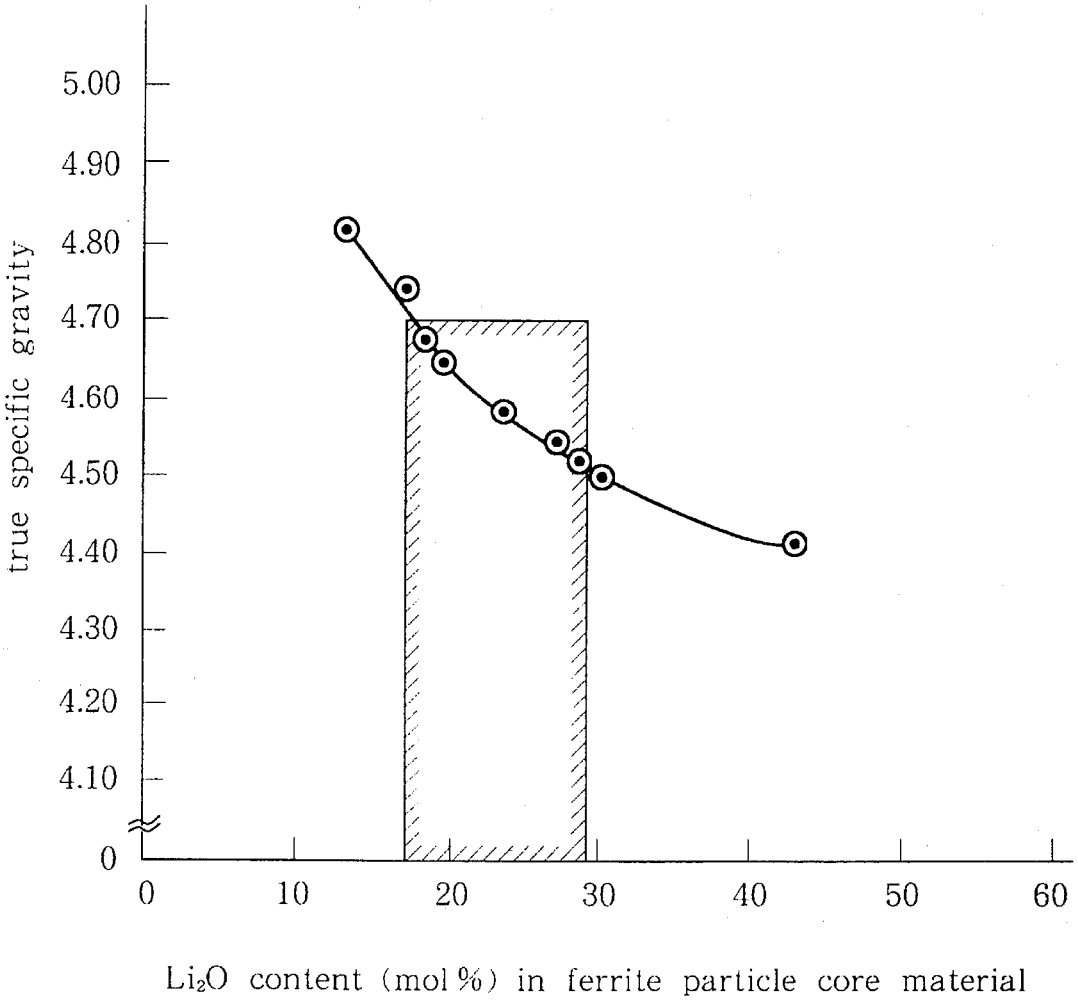
FIG. 1 is a graph showing the relationship between the $Li_2O$ content (mol %) of Li-based ferrite and the true specific gravity.
Figure 2:
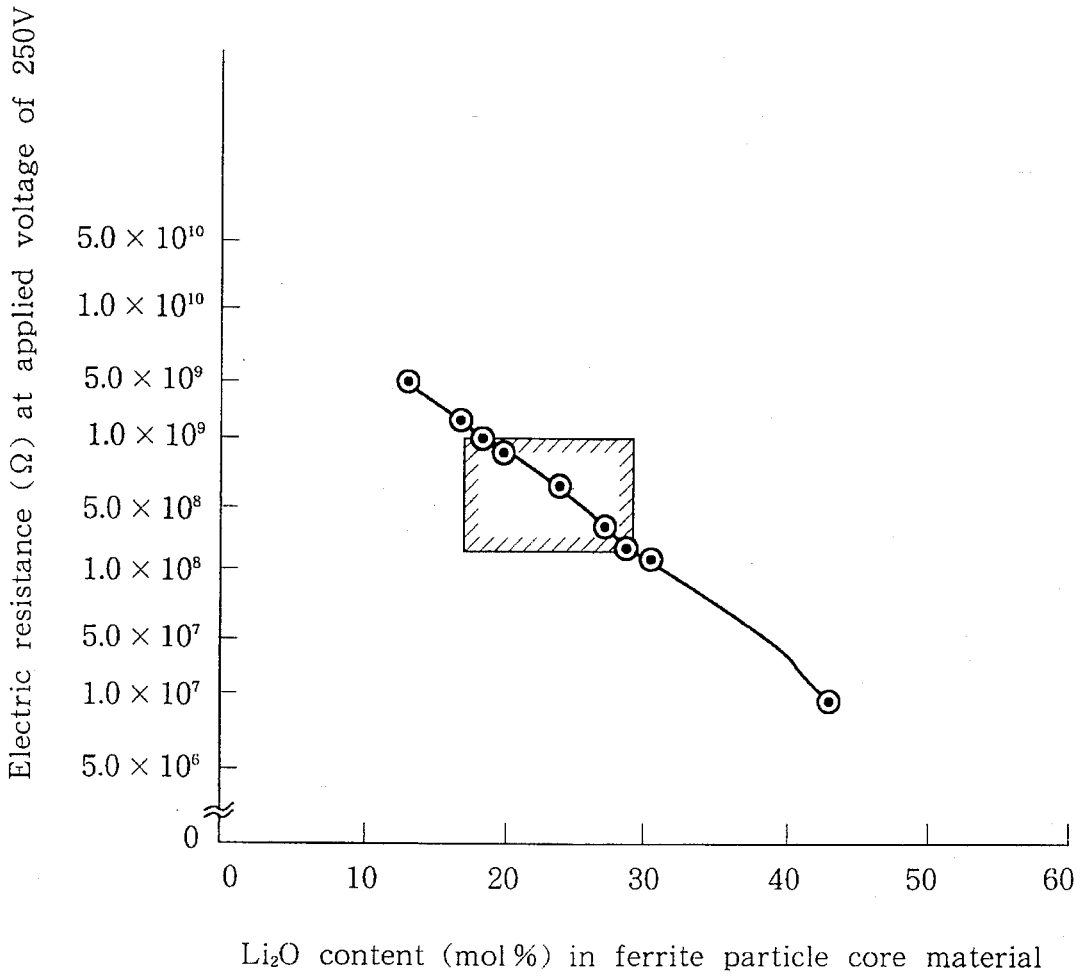
FIG. 2 is a graph showing the relationship between the $Li_2O$ content (mol %) of Li-based ferrite and the resistance (Ω) thereof exhibited when a voltage of 250 V is applied thereto.
Figure 3:
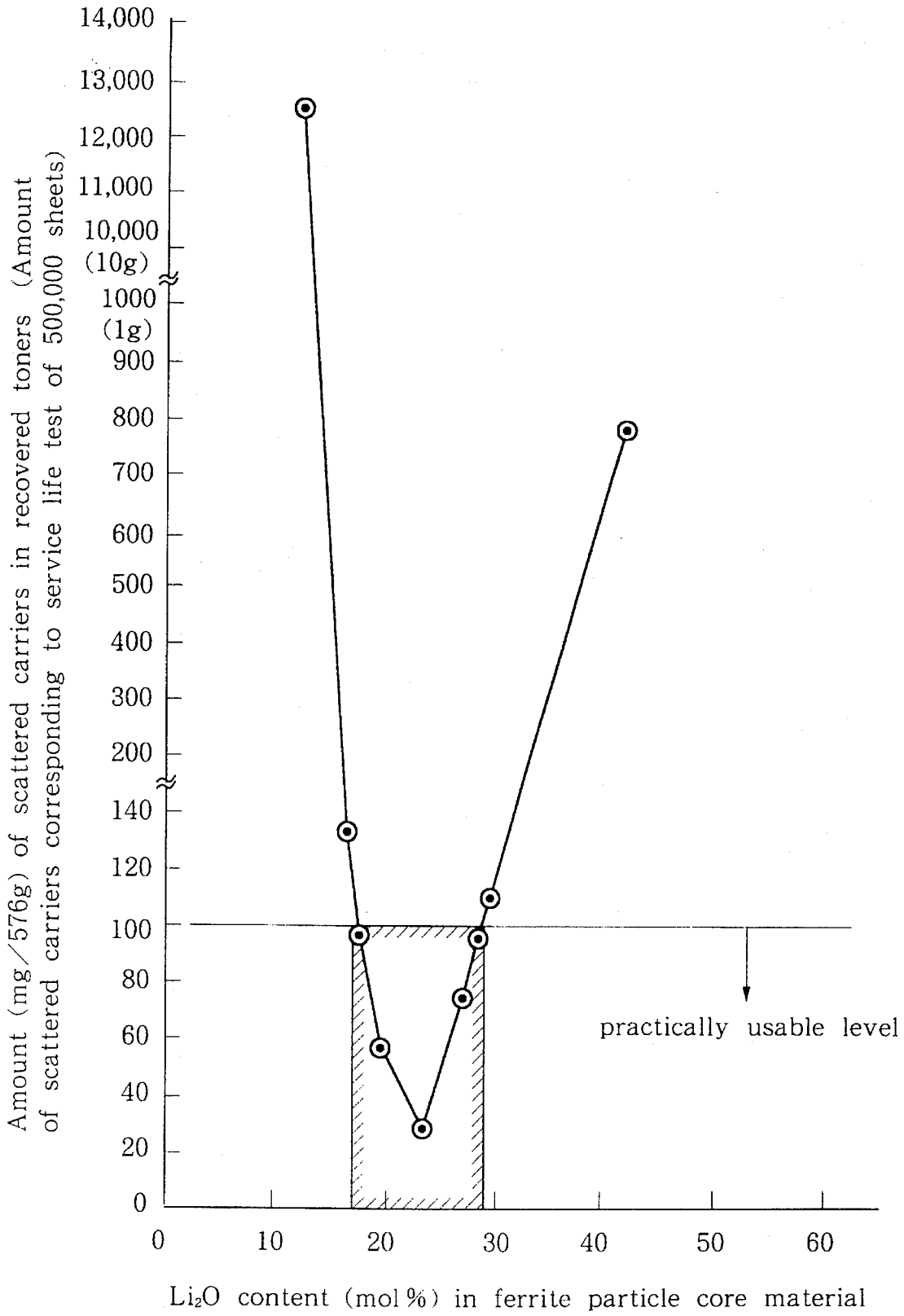
FIG. 3 is a graph showing the relationship between the $Li_2O$ content (mol %) of Li-based ferrite and the Amount (mg/576 g) of scattered carrier particles.

The relationship between the $Li_2O$ content (mol %) of Li-based ferrite particle and the true specific gravity is shown in FIG. 1, that between the $Li_2O$ content of Li-based ferrite particle and the electric resistance in FIG. 2, and that between the $Li_2O$ content of Li-based ferrite particle and the amount of scattered carrier particles in FIG. 3, respectively. It can be understood from the FIGS. 1 to 3 that a material containing a stoichiometric Ferrite and having a $Li_2O$ content lower than 17.0 mol % exhibits neither desired true specific gravity nor desired resistance and exhibits an extreme increase the amount of scattered carrier particles.

When the $Li_2O$ content is larger than a certain value, as shown in FIG. 3, the resulting carrier will scatter significantly when practically used in a copying machine, though a desired true specific gravity and a desired resistance can be attained.

The amounts of scattered carrier given in FIG. 3 were each determined as follows by using Li-based ferrite particles having a certain Li content (mol %) as the carrier core material. A silicone resin (trade name: SR-2411, solid content: 20% by weight, produced by Toray-Dow Corning Silicone Co., Ltd.) was dissolved in toluene and applied to the above Li-based ferrite particles by the use of a fluidized bed in an amount of 0.6% by weight based on the core material. The thus coated particles were baked at 250° C. for 3 hours to give a resin-coated ferrite carrier. 576 g of the thus coated ferrite carrier (sample) was mixed with a toner for Leo-Dry 7610 mfd. by Toshiba Corporation to prepare a developer having a toner concentration of 4.0% by weight. Simulative service life test corresponding to the copying of 500,000 sheets (in which the copying operation is conducted without feeding any sheet and the toner present on the photoreceptor is completely recovered into a toner box through a blade) was conducted by using a Leo-Dry 7610 copying machine mfd. by Toshiba Corporation and the above developer. The carrier particles were separated from the toner recovered into the toner box with a magnet and weighed.

The saturation magnetization of particulate Li-based ferrite can be varied from about 43 to 70 emu/g by changing the proportions (mol %) of the constituents.

The Li-based ferrite particles may be incorporated thereinto with a slight amount of inorganic materials such as $SiO_2$, $CaCO_3$, $TiO_2$, $Bi_2O_3$, $Al_2O_3$ to control the surfaces of the particles.

The above particulate Li-based ferrite must exhibit a resistance of $2.5\times10^8$ to $2.5\times10^9$ Ω, preferably $3.5\times10^8$ to $1.0\times10^9$ Ω when a voltage of 250 V is applied thereto.

When the Li-based ferrite carrier exhibits a resistance lower than $2.5\times10^8$ Ω when a voltage of 250 V is applied thereto, the images developed with the resulting carrier will be poor in resolution owing to the too low resistance. Further, even when the Li-based ferrite carrier is coated with a resin, the resin layer will peel off due to the friction and/or collision of carrier particles with each other during the service life test to cause a marked variation in the carrier resistance. Therefore, the obtained copies will exhibit a marked variation in the density of solid black images and will be poor in gradation. Further, problematic carrier scattering will occur unfavorably.

If the ferrite carrier exhibits a high resistance exceeding $2.5\times10^9$ Ω which is not different from that of the ferrite carrier of the prior art, the development using the resulting resin-coated ferrite carrier will be affected by the high resistance of the core to give copies which are excellent in resolution owing to the edge effect but contains solid black images characterized by low-density central area. This tendency is particularly remarkable when the carrier is used in a laser beam printer of reversal development system involving the application of a high bias voltage, so that the solid black images thus developed are completely thin and poor in quality unfavorably.

According to the present invention, when the resistance ($R_1$) exhibited when a voltage of 250 V is applied thereto is taken as $a_1\times10^b$ Ω, and the resistance ($R_2$) exhibited when a voltage of 1000 V is applied thereto is taken as $a_2\times10^b$ Ω, the ferrite carrier must satisfy the relationship: $a_1-a_2\leqq1.5$ (wherein $1.0\leqq a_1<10$, $0.1\leqq a_2$, and b is an integer of 6 to 9). It is preferable to satisfy the relationship: $a_1-a_2\leqq1.0$ (wherein $1.0\leqq a_1<10$, $0.1\leqq a_2$, and b is an integer of 7 to 9), still preferably $a_1-a_2\leqq0.7$. If the difference ($a_1-a_2$) exceeds 1.5, the resulting resin-coated carrier will exhibit high voltage dependence when the resin layer falls or peel off owing to the fraction and/or collision of carrier particles with each other in the service life test, which causes a marked change in the developed images. Further, the images developed with the carrier will be generally poor in gradation.

Figure 4:
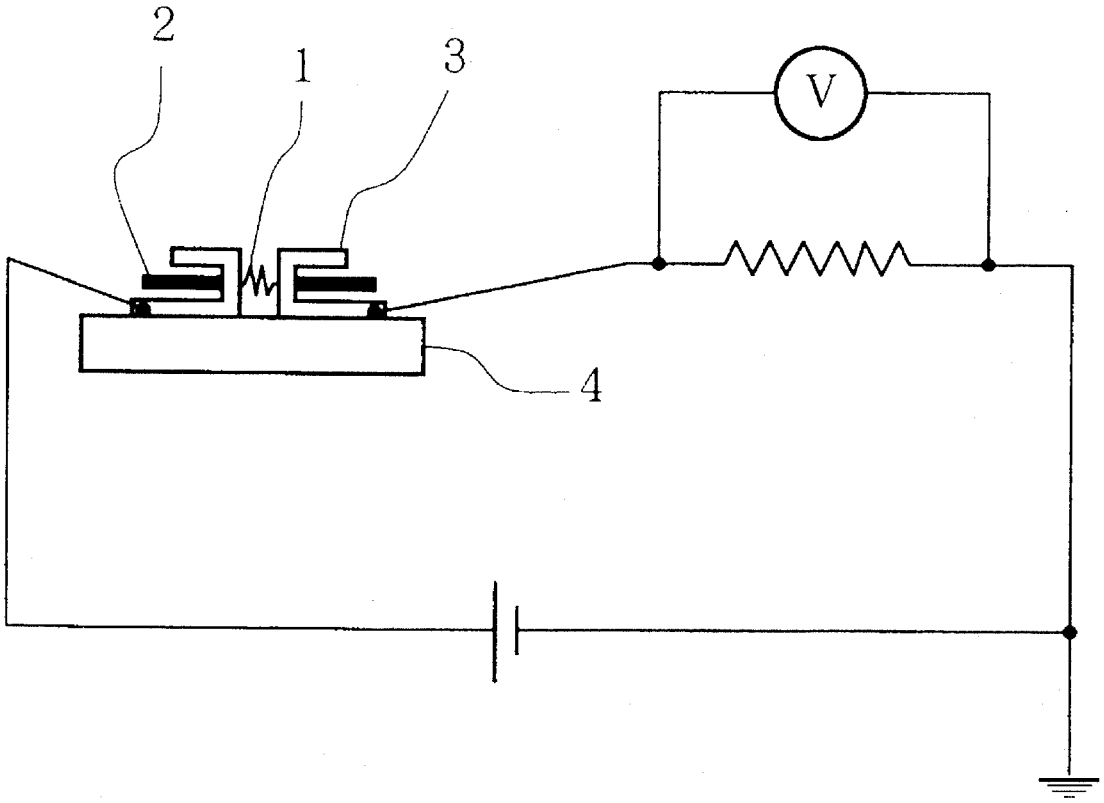
FIG. 4 is a schematic view of an ohm-meter.

In the present invention, each electric resistance was determined by the use of an ohm-meter shown in FIG. 4, wherein numeral 1 refers to a carrier (sample), numeral 2 refers to a magnetic pole, numeral 3 refers to a brass plate, and numeral 4 refers to a fluororesin plate. Specifically, N and S poles were oppositely set at an interval of 6.5 mm and 200 mg of a sample was weighed and inserted between nonmagnetic plate electrodes (area; 10×40 mm) set parallel to each other. The above magnetic poles (surface magnetic flux density: 1500 Gauss, facing pole area: 10×30 mm) were attached to the plate electrodes to keep the sample between the electrodes. A voltage of 250 V or 1000 V was applied thereto to determine the resistance by the use of an insulation-resistance tester or ammeter.

The carrier prepared by coating the above ferrite particle (core material) with a resin must exhibit a resistance of $1.0\times10^9$ to $1.0\times10^{15}$ Ω, preferably $1.0\times10^{10}$ to $1.0\times10^{14}$ Ω when a voltage of 250 V is applied to it. When the carrier exhibits a resistance lower than $1.0\times10^9$ Ω, no desired gradation will be attained in development, and the carrier will be poor in durability because of the thinness of the resin layer. On the contrary, when the carrier exhibits a resistance exceeding $1.0\times10^{15}$ Ω, the reproduction of solid black areas will be difficult owing to the edge effect even when a ferrite particle having a low resistance is used as the core material.

The ferrite carrier of the present invention must have a true specific gravity of 4.70 or below, preferably 4.67 or below, still preferably 4.67 to 4.52. When a heavy Li-based ferrite carrier having a true specific gravity exceeding 4.70 is used in the service life test, the "spent"-phenomenon of toner will occur and the resistance of the carrier will significantly varies owing to the peeling of the resin layer caused by the friction and/or collision of carrier particles with each other. In other words, such a heavy ferrite carrier is not superior to the ferrite carrier of the prior art, being not preferable. When the true specific gravity is less than 4.52, the resulting carrier will be poor in strength and in danger of scattering. The true specific gravity of each carrier can be determined with a True-denser FIT-2000 type (trade name) mfd. by Seishin Kigyo or an instrument similar thereto.

The mean particle diameter of the ferrite carrier of the present invention is about 15 to 200 μm, preferably 20 to 150 μm, still preferably 20 to 100 μm. When the mean particle diameter is less than 15 μm, the resulting carrier will contain an increased amount of too fine particles to exhibit a lowered magnetization per particle, which is causative of carrier scattering in development. When the mean particle diameter exceeds 200 μm, the resulting carrier will have a lowered specific surface area, so that toner scattering will occur in development and the reproduction of solid black area will be difficult.

Next, the preparation of the ferrite carrier of the present invention will briefly be described.

$Fe_2O_3$ is blended with $Li_2O$ or $Li_2CO_3$ which is finally converted into $Li_2O$ at such a ratio so as to give a Li-based ferrite composed of 17.0 to 29.0 mol % of $Li_2O$ and 71.0 to 83.0 mol % of $Fe_2O_3$, generally followed by the addition of water. The thus obtained mixture is agitated and ground on a wet ball mill or wet vibration mill for at least one hour. The slurry thus prepared is dried, pulverized and then calcined at 700° to 1200° C. When a lower apparent density is desired, the calcination may be omitted. The resulting mixture is further ground into a particle diameter of 15 μm or below, preferably 5 μm or below, still preferably 2 μm or below on a wet ball mill or wet vibration mill. If necessary, a dispersing agent and/or a binder is added to the resulting slurry to control the viscosity. The resulting mixture was granulated and then kept at 1000° to 1500° C. for 1 to 24 hours to conduct final firing.

The thus finally fired product is ground and then size-classified. The product thus prepared may be, if necessary, reduced to some extent and then subjected to surface re-oxidation at low temperature.

Various resins can be used to coat the Li-based ferrite particles prepared above. Examples of the resin to constitute the carrier used together with a positively chargeable toner are fluororesin, fluoroacrylic resin and silicone resin, among which condensation-type silicone resin is preferable. On the other hand, examples of the resin to constitute the carrier used together with a negatively chargeable toner are acryl-silicone resin, a mixture of acryl-styrenic resin with melamine resin, a product of hardening of the mixture, silicone resin, acryl-modified silicone resin, epoxy resin and polyester resin, among which a product of hardening of a mixture of acryl-styrenic resin with melamine resin and condensation-type silicone resin are preferable. A silicone resin containing an aminosilane coupling agent is still preferable. If necessary, a charge controller or a resistance controller may be added.

It is preferable that a resin described above be applied to the core material in an amount of 0.05 to 10.0% by weight, still preferably 0.1 to 7.0% by weight based on the core material. When the amount is less than 0.05% by weight, no uniform resin layer will be formed on the surface of the core material, while when the amount exceeds 10% by weight, the resin layer will be so thick, that granulation will occur among carrier particles to give not uniform carrier particles.

The coating of the core material with a resin is generally conducted by dissolving a resin in a solvent and applying the solution to the core material. The solvent usable in this solution may be any one in which the resin is soluble. When the resin is soluble in an organic solvent, examples of the solvent to be used are toluene, xylene, butyl cellosolve acetate, methyl ethyl ketone, methyl isobutyl ketone, and methanol. When a water-soluble resin or a resin of emulsion type is used, water may be used as the solvent. The application of the resin diluted with the solvent to the core material is conducted by dipping, spraying, brushing, kneading or the like, followed by the removal of the solvent by evaporation. The coating may be conducted by a dry method of applying a powdery resin to the core material as well as the above wet method using a solvent.

The resin-coated Li-based ferrite particle prepared above is baked by any of external and internal methods. For example, the baking may be conducted by the use of a fixed or fluidized electric furnace, a rotary electric furnace or a burner furnace or by micro-wave heating. The baking must be conducted at a temperature which is equal to or exceeds the melting point or glass transition point of the resin, though the baking temperature varies depending upon the resin used. When a thermosetting resin or a resin of condensation type is used, it is necessary to raise the baking temperature to such a level as to make the curing to proceed sufficiently.

After the coating of the core material (Li-based ferrite particle) with a resin and the baking of the resulting resin-coated Li-based ferrite particle have been conducted, the obtained material is cooled, pulverized and subjected to size classification to give a resin-coated carrier.

The ferrite carrier of the present invention is mixed with a toner to be used as a two-component type developer. The toner is a dispersion of a colorant and the like in a binder resin. The binder resin to be used in the toner is not particularly limited and includes polystyrene, chloropolystyrene, styrene-chlorostyrene copolymer, styrene-acrylic ester copolymer, styrenemethacrylic acid copolymer, rosin-modified maleic resin, epoxy resin, polyester resin, polyethylene resin, polypropylene resin, polyurethane resin and so forth. These resins may be used either alone or as a mixture of two or more of them.

The charge controller to be used in the present invention may be any arbitrary one. Examples of the charge controller suitable for a positively chargeable toner are nigrosine dye and quaternary ammonium salts, while those of the charge controller for a negatively chargeable toner include metal-containing monoazo dyes.

The colorant to be used in the present invention may be any of known dyes and pigments. Examples of the colorant are carbon black, copper phthalo-cyanine blue, permanent red, chrome yellow and copper phthalocyanine green. The colorant may be used in an amount of about 0.5 to 10% by weight based on the binder resin. Further, other additives such as finely powdered silica or titania may be added to the toner particles as needed to improve the fluidity and agglomeration resistance of the toner particles.

The process for preparing the toner to be used in the present invention is not particularly limited. For example, the toner can be prepared by a process which comprises sufficiently mixing a binder resin with a charge controller and a colorant with a Henschel mixer or the like, melt-kneading the obtained mixture with a twin-screw extruder or the like, cooling the kneaded mixture, subjecting the resulting mixture to grinding and size classification, and mixing the resulting particles with additives with a mixer.

DESCRIPTION OF THE PREFERRED EMBODIMENTS

The present invention will now be described in more detail by referring to the following Examples and Comparative Examples.

EXAMPLE 1

$Li_2O$ (19.8 mol %) and $Fe_2O_3$ (80.2 mol %) were ground and mixed with each other by the use of a wet ball mill for 10 hours. The thus obtained mixture was dried and then kept at 900° C. for 3 hours to conduct calcining. The thus calcined product was ground on a wet ball mill for 24 hours to give a slurry containing particles having a particle diameter of 5 μm or below. A dispersing agent and a binder in suitable amounts were added to the slurry and the thus obtained mixture was granulated and then dried through a spray dryer. The thus obtained particles were kept at 1150° C. in an electric furnace for 4 hours to conduct final firing. The thus finally fired product was pulverized and then classified to give core materials consisting of ferrite particle having a mean particle diameter of 73 μm and a particle diameter distribution of 45 to 105 μm.

The analysis of the thus prepared ferrite core material showed that the core material was composed of 19.5 mol % of $Li_2O$ and 80.5 mol % $Fe_2O_3$. When a voltage of 250 V was applied to the ferrite core material, the material exhibited a resistance ($R_1$) of $9.3\times10^8$ Ω, while when a voltage of 1000 V was applied to the material, the material exhibited a resistance ($R_2$) of $8.8\times10^8$ Ω. The difference ($a_1-a_2$) was 0.5.

The ferrite core material was also examined for magnetic properties. The material exhibited a magnetization of 57 emu/g when a magnetic field of 3000 Oe was applied thereto. The residual magnetization was 1 emu/g or below and the coercive force was 8 Oe. Further, the apparent density was 2.28 g/cm$^3$.

A solution prepared by dissolving a mixture comprising 75% by weight of an acryl-styrenic resin and 25% by weight of a melamine resin in methanol was applied to the above ferrite particle as the core material by the use of a fluidized bed in an amount of 4.0% by weight based on the core material. The resulting particles were baked at 140° C. for 3.5 hours to give a resin-coated ferrite carrier.

The thus resin-coated ferrite carrier exhibited a resistance of $9.8\times10^{13}$ Ω when a voltage of 250 V was applied thereto, and the true specific gravity of the carrier was 4.65.

The thus prepared ferrite carrier was evaluated by the use of a (negatively chargeable) black toner for Leo-Dry 7610 mfd. by Toshiba Corporation. Specifically, a developer having a toner concentration of 4.0% by weight was prepared and then subjected to the service life test (of copying 500,000 sheets) using a copying machine, Leo-Dry 7610 (mfd. by Toshiba Corporation) to estimate the characteristics of carrier and toner such as carrier resistance variation and charge variation including environmental variation, and image evaluations such as image density including the uniformness of solid black images), fog on the image, carrier scattering (white spots), gradation, resolution, white streak, black spotting and overall evaluation. The results are given in Tables 1 to 3.

The results of each evaluation item were classified into five ranks and are shown by symbols of from ⊙ to x in Tables 1 to 3. The levels of Δ or above are acceptable to practical use. The specific methods of the evaluation are as follows:

[Evaluation of carrier by service life test]

1: Resistance variation

At the initial stage of the service life test and after copying 300,000 or 500,000 sheets according to the service life test, the developer used was washed to remove the toner and the recovered carrier was dried and thereafter examined for resistance by applying a voltage of 250 V thereto. The ratio of the resistance after the copying to the initial one was calculated to evaluate the resistance variation. The results were ranked as follows:

⊙: 95% or above,

○: 80% or above but below 95%,

Δ: 60% or above but below 80%,

▲: 30% or above but below 60%, x: below 30%.

[Evaluation of the characteristics of developer by service life test]

2: Variation of amount of charge including environmental variation

Part of the developer used in the service life test of copying 300,000 or 500,000 sheets was allowed to stand at 10° C. and 15% RH for 24 hours and thereafter examined for the amount of charge ($Q_{LL}$), while another part was allowed to stand at 30° C. and 85% RH for 24 hours and thereafter examined for the amount of charge ($Q_{HH}$). Thus, the difference (Δ Q) was determined.

$$\Delta Q=Q_{LL}-Q_{HH}\ (\mu c/g)$$

The results were ranked to the environmental variation of charge.

⊙: ΔQ=not more than 3 μc/g,

○: ΔQ exceeds 3 μc/g but not exceeds 5 μc/g,

Δ: ΔQ exceeds 5 μc/g but not exceeds 7 μc/g,

▲: ΔQ exceeds 7 μc/g but not exceeds 12 μc/g, x: ΔQ exceeds 12 μc/g

The amount of charge of each developer was determined by the use of E-SPART ANALYZER (trade name) mfd. by Hosokawa Micron.

[Image evaluation by service life test]

3: Image density (I.D.): including the uniformity of solid black images

Copying was conducted under proper exposure conditions and the obtained copies were evaluated I.D. (including the uniformness of solid black images). The image density of a solid black image was determined with a Macbeth densitometer. Further, the uniformity of a solid black image was evaluated with the naked eye and the results are ranked by referring to criterial samples.

⊙: the density of the original is well reproduced with solid black images being uniform and free from unevenness in density, ○: the density of the original is reproduced without unevenness in density, Δ: the image density is acceptable (level acceptable to practical use), ▲: ununiform images accompanied with many white streaks, though the image density is acceptable, x: the density is low over the entire image, accompanied with significant edge effect, and the image density is far lower than the original one.

4: Fog on the image

The fog on the image was evaluated by determining the toner fog of each copy on its white ground with a colorimetric color-difference meter z- 300 (trade name) mfd. by Nippon Denshoku Kogyo. The results were ranked.

⊙: below 0.5%,

○: 0.5% or above but below 1.0%,

Δ: 1.0% or above but below 1.5%,

▲: 1.5% or above but below 2.5%, x: 2.5% or above.

5: White spotting (carrier scattering)

Each copy was evaluated for carrier scattering, i.e., extent of white spotting. The results were ranked.

⊙: no white spot on ten A3-size copies,

○: 1 to 5 white spots on ten A3-size copies,

Δ: 6 or more white spots on ten A3-size copies but at most 3 white spots on three A3-size copies, ▲: 6 to 10 white spots on three A3-size copies, x: 11 or more white spots on three A3-size copies.

6: Gradation

Copies were made under proper exposure conditions and evaluated for gradation with a gray scale (0 to 19 gradation test chart) based on the number of density patterns discriminated with the naked eye.

⊙: 15, (B) or above

○: 13 to 14,

Δ: 11 to 12,

▲: 7 (M) to 10, x: 6 or below.

7: Resolution

Copies were made under proper exposure conditions and examined for resolution by determining the resolving power pattern (1.6 to 16) discriminated with the naked eye by the use of the test chart No. 2-T of the Society of Electrophotography of Japan. The results were ranked.

⊙: the pattern of 6.3 or above can be read,

○: four lines of 5.0 can be well reproduced (both lengthwise and crosswise),

Δ: four lines of 5.0 can be read,

▲: Four lines of 4.0 can be read, x: four lines of 3.2 can be read.

8: White streak (referring to the phenomenon caused by linear surface flaws of the photoreceptor drum given by stress occurring in recovering carrier particles scattering onto the drum by a blade)

Each copy was evaluated for the extent of white streak on the halftone (gray) chart.

⊙: no white streaks on an A3-size copy,

○: 1 to 3 fine white streaks on an A3-size copy,

Δ: 4 to 10 white streaks on an A3-size copy,

▲: 11 or more white streaks on an A3-size copy, x: many white streaks and voids on an A3-size copy.

9: Black spotting (referring to the phenomenon wherein black spots are developed on copies owing to the filing of toner particles into flaws on the drum surface)

Each copy was evaluated for the extent of black spotting on its white ground and the results were ranked.

⊙: no black spot on an A3-size copy,

○: 1 to 3 fine black spots on an A3-size copy,

Δ: 4 to 10 black spots on an A3-size copy,

▲: 11 to 30 black spots on an A3-size copy, x: more black spots on an A3-size copy.

10: Overall evaluation

Copies were made after the service life test and evaluated for overall quality [including image density (including the unevenness of solid black images), fog on the image, carrier scattering (white spotting), gradation, resolution, white streak and black spotting). The results were ranked.

⊙: very good with respect to all evaluation items,

○: not problematic with respect to all evaluation items,

Δ: acceptable to practical use with respect to all evaluation items,

▲: problematic with respect to some of the evaluation items and unsuitable For practical use, x: problematic with respect to most of the evaluation items and practically unusable.

EXAMPLE 2

A ferrite core material having a mean particle diameter of 90 μm and a particle diameter distribution of 65 to 125 μm was prepared by the use of $Li_2O$ (24.0 mol %) and $Fe_2O_3$ (76.0 mol %) in the same manner as that of the Example 1.

The analysis of the thus prepared ferrite core material showed that the core material was composed of 23.5 mol % of $Li_2O$ and 76.5 mol % of $Fe_2O_3$. When a voltage of 250 V was applied to the ferrite core material, the material exhibited a resistance ($R_1$) of $7.1\times10^8$ Ω, while when a voltage of 1000 V was applied to the material, the material exhibited a resistance ($R_2$) of $6.9\times10^8$ Ω. The difference ($a_1-a_2$) was 0.2.

The ferrite core material was also examined for magnetic properties. The material exhibited a magnetization of 50 emu/g when a magnetic field of 3000 Oe was applied thereto. The residual magnetization was 1 emu/g or below and the coercive force was 13 Oe. Further, the apparent density was 2.15 g/cm A solution prepared by dissolving a silicone resin (trade name: TSR-127B, solid content: 50% by weight, produced by Toshiba Silicone Co., Ltd.) in toluene and adding an amount of 2% (based on the resin) of a catalyst (trade name: CR-12, produced by Toshiba Silicone Co., Ltd.) thereto was applied to the above ferrite core material by the use of a fluidized bed in an amount of 0.9% by weight based on the core material. The resulting particles were baked at 200° C. for 2 hours to give a resin-coated ferrite carrier.

The thus resin-coated ferrite carrier exhibited a resistance of $5.0\times10^{12}$ Ω when a voltage of 250 V was applied thereto, and the true specific gravity of the carrier was 4.58.

The thus prepared ferrite carrier was evaluated by the use of a (positively chargeable) black toner for SF-9400 mfd. by Sharp Corporation. Specifically, a developer having a toner concentration of 4.0% by weight was prepared and then subjected to the service life test (of copying 500,000 sheets) using a copying machine SF-9400 (mfd. by Sharp Corporation) to evaluate the characteristics of carrier and developer, and image qualities. The results are given in the Tables 1 to 3.

EXAMPLE 3

$Li_2CO_3$ (27.4 mol %) and $Fe_2O_3$ (72.6 mol %) were ground and mixed with each other by the use of a wet ball mill for 10 hours. The thus obtained mixture was dried and kept at 900° C. for 3 hours to conduct calcining. The thus calcined product was ground on a wet ball mill for 20 hours to give a slurry containing particles having a particle diameter of 5 μm or below. A dispersing agent and a binder in suitable amounts were added to the slurry and the thus obtained mixture was granulated and dried through a spray dryer. The thus obtained particles were kept at 1100° C. in an electric furnace for 4 hours to conduct final firing. The thus finally fired product was pulverized and then classified to give core materials consisting of ferrite particle having a mean particle diameter of 50 μm and a particle diameter distribution of 30 to 65 μm.

The analysis of the thus prepared ferrite core material revealed that the ferrite was composed of 27.0 mol % of $Li_2O$ and 73.0 mol % of $Fe_2O_3$. When a voltage of 250 V was applied to the ferrite, the ferrite exhibited a resistance ($R_1$) of $4.2\times10^8$ Ω, while when a voltage of 1000 V was applied to the ferrite, it exhibited a resistance ($R_2$) of $4.0\times10^8$ Ω. The difference ($a_1-a_2$) was 0.2.

The ferrite core material was also examined for magnetic properties. The ferrite exhibited a magnetization of 45.0 emu/g when a magnetic field of 3000 Oe was applied thereto. The residual magnetization was 1 emu/g or below and the coercive force was 10 Oe. Further, the apparent density was 2.08 g/cm$^3$.

A solution prepared by dissolving a silicone resin (trade name: SR-2411, solid content: 20% by weight, produced by Toray-Dow Corning Silicone Co., Ltd.) in toluene was applied to the above ferrite core material by the use of a fluidized bed in an amount of 0.6% by weight based on the ferrite. The resulting particles were baked at 250° C. for 3 hours to give a resin-coated ferrite carrier.

The thus resin-coated ferrite carrier exhibited a resistance of $3.0\times10^{11}$ Ω when a voltage of 250 V was applied thereto, and the true specific gravity of the carrier was 4.54.

The thus prepared ferrite carrier was evaluated by the use of the same toner (negatively chargeable) as that used in the Example 1. Specifically, a developer having a toner concentration of 5.0% by weight was prepared and then subjected to the service life test (of copying 500,000 sheets) using a copying machine Leo-Dry 7610 (mfd. by Toshiba Corporation) to evaluate the characteristics of carrier and developer, and image qualities. The results are given in the Tables 1 to 3.

EXAMPLE 4

A ferrite core material having a mean particle diameter of 70 μm and a particle diameter distribution of 45 to 105 μm was prepared by the use of $Li_2CO_3$ (18.3 mol %) and $Fe_2O_3$ (81.7 mol %) in the same manner as that of the Example 3. The thus prepared material was subjected to surface reduction in a hydrogen gas atmosphere at 250° C. for 2 hours, and thereafter oxidized in the open air at 200° C. with a rotary furnace.

The analysis of the resulting material showed that the material was composed of 18.0 mol % of $Li_2O$ and 82.0 mol % of $Fe_2O_3$. When a voltage of 250 V was applied to the material, the material exhibited a resistance ($R_1$) of $2.3\times10^9$ Ω, while when a voltage of 1000 V was applied to the material, the material exhibited a resistance ($R_2$) of $1.0\times10^9$ Ω. The difference ($a_1-a_2$) was 1.3.

The material was also examined for magnetic properties. The material exhibited a magnetization of 61 emu/g when a magnetic field of 3000 Oe was applied thereto. The residual magnetization was 1 emu/g or below and the coercive force was 10 Oe. Further, the apparent density was 2.37 g/cm$^3$.

A solution prepared by dissolving a mixture comprising 70% by weight of a fluororesin (vinylidene fluoride-tetrafluoroethylene copolymer) and 30% by weight of an acryl-styrenic resin in methyl ethyl ketone was applied to the ferrite core material by the use of a fluidized bed in an amount of 1.5% by weight based on the core material. The resulting particles were baked at 170° C. for 2 hours to give a resin-coated ferrite carrier.

The thus resin-coated ferrite carrier exhibited a resistance of $8.4\times10^{13}$ Ω when a voltage of 250 V was applied thereto. The true specific gravity of the carrier was 4.68.

The thus prepared ferrite carrier was evaluated by the use of the same toner (positively chargeable) as that used in the Example 2. Specifically, a developer having a toner concentration of 4.0% by weight was prepared and then subjected to the service life test (of copying 500,000 sheets) using a copying machine, SF-9400 (mfd. by Sharp Corporation) to evaluate the characteristics of carrier and developer and image qualities. The results are given in the Tables 1 to 3.

EXAMPLE 5

A ferrite core material having a mean particle diameter of 50 μm and a particle diameter distribution of 30 to 65 μm was prepared by the use of $Li_2CO_3$ (29.0 mol %) and $Fe_2O_3$ (71.0 mol %) in the same manner as that of the Example 3.

The analysis of the thus prepared ferrite core material showed that the core material was composed of 28.5 mol % of $Li_2O$ and 71.5 mol % of $Fe_2O_3$. When a voltage of 250 V was applied to the ferrite core material, the material exhibited a resistance ($R_1$) of $3.0\times10^8$ Ω, while when a voltage of 1000 V was applied to the material, the material exhibited a resistance ($R_2$) of $2.6\times10^8$ Ω. The difference ($a_1-a_2$) was 0.4.

The ferrite core material was also examined for magnetic properties. The material exhibited a magnetization of 43.0 emu/g, when a magnetic field of 3000 Oe was applied thereto. The residual magnetization was 1 emu/g or below and the coercive force was 12 Oe. Further, the apparent density was 2.04 g/cm$^3$.

The ferrite core material prepared above was coated with the same resin solution as that used in the Example 3 in the same manner as that of the Example 3, with the amount of the resin applied being the same as that of the Example 3. The resulting particles were baked in the same manner as that of the Example 3 to give a resin-coated ferrite carrier.

The thus resin-coated ferrite carrier exhibited a resistance of $6.0\times10^{13}$ Ω when a voltage of 250 V was applied thereto. The true specific gravity of the carrier was 4.52.

The thus prepared ferrite carrier was evaluated by the use of the same toner (negatively chargeable) as that used in the Example 1. Specifically, a developer having a toner concentration of 5.0% by weight was prepared and then subjected to the service life test (of copying 500,000 sheets) using a copying machine Leo-Dry 7610 (mfd. by Toshiba Corporation) to evaluate the characteristics of carrier and developer and image qualities. The results are given in the Tables 1 to 3.

The ferrite core material was coated in the same manner as that of the Example 3 wherein the resin used and the amount of the resin applied were the same as those of the Example 3. The resulting particles were baked in the same manner as that of the Example 3 to give a resin-coated ferrite carrier.

The thus resin-coated ferrite carrier exhibited a resistance of $6.8\times10^9$ Ω, when a voltage of 250 V was applied thereto. The true specific gravity of the carrier was 4.41.

The thus prepared Ferrite carrier was evaluated by the used of the same toner (negatively chargeable) as that used in the Example 1. Specifically, a developer having a toner concentration of 5.0% by weight was prepared and then subjected to the service life test (of copying 500,000 sheets) using a copying machine, Leo-Dry 7610 (mfd. by Toshiba Corporation) to evaluate the characteristics of carrier and developer, and image qualities. The results are given in the Tables 1 to 3.

Comparative Example 5

A ferrite core material having a mean particle diameter of 95 μm and a particle diameter distribution of 150 to 65 μm was prepared by the use of CuO (15.5 mol %), ZnO (81.5 mol %) and $Fe_2O_3$ (53 mol %) in the same manner as that of the Example 2.

The analysis of the thus prepared ferrite core material showed that the core material was composed of 16.0 mol % of CuO, 31.0 mol % of ZnO and 53 mol % of $Fe_2O_3$. When a voltage of 250 V was applied to the ferrite core material, the material exhibited a resistance ($R_1$) of $8.5\times10^9$ Ω, while when a voltage of 1000 V was applied to the material, the material exhibited a resistance ($R_2$) of $5.8\times10^9$ Ω. The difference ($a_1-a_2$) was 2.7.

The ferrite core material was also examined for magnetic properties. The material exhibited a magnetization of 57 emu/g, when a magnetic field of 3000 Oe was applied thereto. The residual magnetization was 1 emu/g and the coercive force was 9 Oe. Further, the apparent density of the material was 2.90 g/cm$^3$.

The ferrite core material was coated in the same manner as that of the Example 2 wherein the resin used and the amount of the resin applied were the same as those of the Example 2. The resulting particles were baked in the same manner as that of the Example 2 to give a resin-coated ferrite carrier.

The thus resin-coated ferrite carrier exhibited a resistance of $1.2\times10^{13}$ Ω, when a voltage of 250 V was applied thereto. The true specific gravity of the carrier was 5.02.

The thus prepared ferrite carrier was evaluated by the use of tile same toner (positively chargeable) as that used in the Example 2. Specifically, a developer having a toner concentration of 4.0% by weight was prepared and then subjected to the service life test (of copying 500,000 sheets) using a copying machine SF-9400 (mfd. by Sharp Corporation) to evaluate the characteristics of carrier and developer, and image qualities. The results are given in the Tables 1 to 3.

Comparative Example 6

NiO (15.5 mol %), ZnO (16.0 mol %) and $Fe_2O_3$ (68.5 mol %) were ground and mixed with each other in a wet ball mill for 10 hours. The thus obtained mixture was dried and then kept at 950° C. for 3 hours to conduct calcining. The thus calcined product was ground on a wet ball mill for 20 hours to give a slurry containing particle having a particle diameter of 5 μm or below. A dispersing agent and a binder in suitable amounts were added to the slurry and the thus obtained mixture was granulated and then dried through a spray dryer. The thus obtained particles were kept at 1350° C. in an electric furnace for 4 hours to conduct final firing. The thus finally fired product was pulverized and then classified to give core materials consisting of ferrite particle having a mean particle diameter of 90 μm and a particle diameter distribution of 65 of to 150 μm.

The analysis of the thus prepared ferrite core material showed that the core material was composed of 15.0 mol % of NiO, 15.0 mol % of ZnO and 70.0 mol % of $Fe_2O_3$. When a voltage of 250 V was applied to the ferrite core material, the material exhibited a resistance ($R_1$) of $2.8\times10^{10}$ Ω, while when a voltage of 1000 V was applied to the material, the material exhibited a resistance ($R_2$) off $1.0\times10^{10}$ Ω. The difference ($a_1-a_2$) was 1.8.

The ferrite core material was also examined for magnetic properties. The material exhibited a magnetization of 45 emu/g, when a magnetic field of 3000 Oe was applied thereto. The residual magnetization was 1 emu/g or below and the coercive force was 18 Oe. Further, the apparent density was 2.75 g/cm$^3$.

The ferrite core material was coated in the same manner as that of the Example 1 wherein the resin used and the amount of the resin applied were the same as those of the Example 1. The resulting particles were baked in the same manner as that of the Example 1 to give a resin-coated ferrite carrier.

The thus resin-coated ferrite carrier exhibited a resistance of $2.1\times10^{15}$ Ω, when a voltage of 250 V was applied thereto. The true specific gravity of the carrier was 5.06.

The thus prepared ferrite carrier was evaluated by the use of the same toner (negatively chargeable) as that used in the Example 1. Specifically, a developer having a toner concentration of 4.0% by weight was prepared and then subjected to the service life test (of copying 500,000 sheets) using a copying machine, Leo-Dry 7610 (mfd. by Toshiba Corporation) to evaluate the characteristics of carrier and developer, and image qualities. The results are given in the Tables 1 to 3.

Comparative Example 7

Surface-oxidized iron powder (trade name: TSV-35, produced by Powdertech Co., Ltd., Japan) was used as the carrier core material. This material had a mean particle diameter of 65 μm and a particle diameter distribution of 45 to 105 μm and exhibited a resistance ($R_1$) of $9.0\times10^9$ Ω when a voltage of 250 V was applied thereto. When a voltage of 1000 V was applied thereto, leakage occurred to fail in determining the resistance.

The material was also examined for magnetic properties. The material exhibited a magnetization of 180 emu/g when a magnetic field of 3000 Oe was applied thereto. The residual magnetization was 2.0 emu/g and the coercive force was 22 Oe. Further, the apparent density was 3.50 g/cm$^3$.

The material was coated in the same manner as that of the Example 2 wherein the resin used and the amount of the resin applied were the same as those of the Example 2. The resulting particles were baked in the same manner as that of the Example 2 to give a resin-coated iron carrier.

The thus resin-coated iron carrier exhibited a resistance of $3.0\times10^{12}$ Ω when a voltage of 250 V was applied thereto. The true specific gravity of the carrier was 7.79.

The thus prepared iron carrier was evaluated by the use of the same toner (positively chargeable) as that used in the Example 2. Specifically, a developer having a toner concentration off 5.0% by weight was prepared and then subjected to the service life test (of copying 500,000 sheets) using a copying machine SF-9400 (mfd. by Sharp (Corporation) to evaluate the characteristics of carrier and developer and image qualities. The results are given in the Tables 1 to 3.

TABLE 1

| | Evaluation of carrier and developer | | | | Practical copying test | | | | | |
|---|---|---|---|---|---|---|---|---|---|---|
| | resistance variation | | charge variation including environmental variation | | image density | | | fog on image | | |
| Ex. and Comp. Ex. | from the initial stage until 300,000-sheet copying | after 300,000-sheet copying until 500,000-sheet copying | from the initial stage until 300,000-sheet copying | after 300,000-sheet copying until 500,000-sheet copying | initial | after 300,000-sheet copying | after 500,000-sheet copying | initial | after 300,000-sheet copying | after 500,000-sheet copying |
| Ex. 1 | ◎ | ◎ | ○ | ○ | ◎ | ○ | ○ | ◎ | ○ | ○ |
| Ex. 2 | ◎ | ◎ | ◎ | ◎ | ◎ | ◎ | ◎ | ◎ | ◎ | ○ |
| Ex. 3 | ◎ | ◎ | ◎ | ◎ | ◎ | ◎ | ◎ | ◎ | ○ | ○ |
| Ex. 4 | ○ | ○ | Δ | Δ | ○ | Δ | Δ | Δ | Δ | Δ |
| Ex. 5 | ◎ | ◎ | ○ | ○ | ◎ | ◎ | ◎ | ◎ | ◎ | ○ |
| Comp. Ex. 1 | ▲ | ▲ | ◎ | Δ | Δ | ▲ | ▲ | Δ | ▲ | ▲ |
| Comp. Ex. 2 | ▲ | ▲ | ▲ | ▲ | ○ | ▲ | ▲ | Δ | ▲ | ▲ |
| Comp. Ex. 3 | ◎ | ○ | ◎ | ○ | ◎ | ○ | ▲ | ◎ | ◎ | Δ |
| Comp. Ex. 4 | Δ | ▲ | Δ | ▲ | ○ | Δ | ▲ | ○ | Δ | ▲ |
| Comp. Ex. 5 | ▲ | ▲ | X | X | ○ | X | X | Δ | X | X |
| Comp. Ex. 6 | ▲ | ▲ | X | X | Δ | X | X | Δ | X | X |
| Comp. Ex. 7 | X | X | X | X | ○ | X | X | ○ | X | X |

TABLE 2

| | Practical copying test | | | | | | | | |
|---|---|---|---|---|---|---|---|---|---|
| | white spot (carrier scattering) | | | gradation | | | resolution | | |
| Ex. and Comp. Ex. | initial | after 300,000-sheet copying | after 500,000-sheet copying | initial | after 300,000-sheet copying | after 500,000-sheet copying | initial | after 300,000-sheet copying | after 500,000-sheet copying |
| Ex. 1 | ◎ | ◎ | ○ | ◎ | ◎ | ◎ | ◎ | ○ | ○ |
| Ex. 2 | ◎ | ◎ | ◎ | ◎ | ◎ | ○ | ◎ | ○ | ○ |
| Ex. 3 | ◎ | ◎ | ○ | ◎ | ◎ | ○ | ◎ | ○ | ○ |
| Ex. 4 | ○ | ▲ | ▲ | ◎ | Δ | Δ | ◎ | Δ | Δ |
| Ex. 5 | ◎ | ○ | Δ | ◎ | ○ | Δ | ◎ | ○ | Δ |
| Comp. Ex. 1 | Δ | X | X | ○ | Δ | Δ | ◎ | Δ | ▲ |
| Comp. Ex. 2 | ▲ | X | X | ○ | ▲ | ▲ | Δ | X | X |
| Comp. Ex. 3 | ◎ | ◎ | Δ | ◎ | ○ | ▲ | ○ | ○ | X |
| Comp. Ex. 4 | ◎ | ○ | ▲ | Δ | ▲ | ▲ | Δ | Δ | X |
| Comp. Ex. 5 | ○ | X | X | ○ | X | X | ○ | ▲ | X |
| Comp. Ex. 6 | Δ | X | X | ○ | ▲ | X | ◎ | Δ | ▲ |
| Comp. Ex. 7 | ◎ | X | X | Δ | X | X | Δ | X | X |

TABLE 3

| Ex. and Comp. Ex. | Practical copying test: white streak: initial | white streak: after 300,000-sheet copying | white streak: after 500,000-sheet copying | black spot: initial | black spot: after 300,000-sheet copying | black spot: after 500,000-sheet copying | Overall evaluation |
|---|---|---|---|---|---|---|---|
| Ex. 1 | ◎ | ◎ | ◎ | ◎ | ◎ | ◎ | ◎ |
| Ex. 2 | ◎ | ◎ | ◎ | ◎ | ◎ | ◎ | ◎ |
| Ex. 3 | ◎ | ◎ | ○ | ◎ | ◎ | ○ | ◎ |
| Ex. 4 | ◎ | Δ | Δ | ◎ | ○ | Δ | Δ |
| Ex. 5 | ◎ | ○ | Δ | ◎ | ○ | Δ | ○ |
| Comp. Ex. 1 | ◎ | Δ | ▲ | ◎ | Δ | ▲ | ▲ |
| Comp. Ex. 2 | ◎ | X | X | ◎ | ▲ | X | ▲ |
| Comp. Ex. 3 | ◎ | Δ | X | ◎ | Δ | ▲ | ▲ |
| Comp. Ex. 4 | ◎ | ▲ | X | ◎ | Δ | X | ▲ |
| Comp. Ex. 5 | ◎ | ▲ | X | ◎ | Δ | ▲ | X |
| Comp. Ex. 6 | ◎ | ▲ | X | ◎ | Δ | ▲ | X |
| Comp. Ex. 7 | ◎ | X | X | ◎ | X | X | X |

[Effect of the Invention]

As described above, the Li-based ferrite core material according to the present invention is characterized in that the $Li_2O$ content is limited within a specific range, so that the Li-based ferrite core material exhibits little voltage dependence and a low resistance and a reduced true specific gravity as compared with those of the ferrite particle of the prior art. Further, a ferrite carrier exhibiting a suitable resistance can be prepared by coating the particulate Li-based ferrite core material with a resin to control the resistance, and the ferrite carrier makes it possible to prepare an electrophotographic developer which can reproduce solid black areas at high density uniformly without causing white streaks and is excellent in durability to give high-quality images excellent in gradation and resolution for a prolonged period. Furthermore, the ferrite carrier for an electrophotographic developer according to the present invention permits wide design freedom for attaining desired image quantities and can clear the severe environmental regulation.

What is claimed is:

1. A ferrite carrier for an electrophotographic developer wherein the core material is ferrite particle composed of 17.0 to 29.0 mol % of $Li_2O$ and 71.0 to 83.0 mol % of $Fe_2O_3$, exhibits a resistance of $2.5\times10^8$ to $2.5\times10^9$ Ω when a voltage of 250 V is applied, satisfies the relationship: $a_1-a_2\leqq1.5$ when the resistance ($R_1$) of the ferrite particle exhibited when a voltage of 250 V is applied thereto is taken as $a_1\times10^b$ Ω and the resistance ($R_2$) thereof exhibited when a voltage of 1000 V is applied thereto is taken as $a_2\times10^b$ Ω with the proviso that $1.0\leqq a_1<10$, $0.1\leqq a_2$, and b is an integer of 6 to 9, and the carrier prepared by coating the ferrite particle with a resin exhibits a resistance of $1.0\times10^9$ to $1.0\times10^{15}$ Ω when a voltage of 250 V is applied thereto, and has a true specific gravity of 4.70 or below.

2. A ferrite carrier for an electrophotographic developer as set forth in claim 1, wherein the core material is a ferrite particle composed of 19.0 to 28.0 mol % of $Li_2O$ and 72.0 to 81.0 mol % of $Fe_2O_3$, exhibits a resistance of $3.5\times10^8$ to $1.0\times10^9$ when a voltage of 250 V is applied thereto, and satisfies the relationship: $a_1-a_2\leqq1.0$ with the proviso that $1.0\leqq a_1<10$, $0.1\leqq a_2$ and b is an integer of 7 to 9.

3. An electrographic developer composed of the ferrite carrier as set forth in claim 1 and a toner.

4. The ferrite carrier for an electrophotographic developer according to claim 1, wherein said carrier has a residual magnetization of 1 emu/g or below.

5. The ferrite carrier according to claim 1, wherein the mean particle diameter is 20–100 μm.

* * * * *